US006408801B1

(12) United States Patent
Frostick et al.

(10) Patent No.: US 6,408,801 B1
(45) Date of Patent: Jun. 25, 2002

(54) METHOD FOR DISSIPATING HEAT AT THE TIP OF A FUEL INJECTOR

(75) Inventors: Lewis Allen Frostick, Sterling Heights; Donald L. Thorson, Oakland; Scott Willis Jorgensen, Bloomfield Township, all of MI (US); Kenneth William Turner, Webster, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/558,624

(22) Filed: Apr. 26, 2000

(51) Int. Cl.[7] ..... F01P 1/06; F02M 15/00
(52) U.S. Cl. ..... 123/41.31; 123/541
(58) Field of Search ..... 123/41.31, 470, 123/557, 541

(56) References Cited

U.S. PATENT DOCUMENTS 6,119,658 A * 9/2000 Jehle et al. ..... 123/41.31
6,155,236 A * 12/2000 Jehle et al. ..... 123/41.31
6,196,195 B1 * 3/2001 Trutschel et al. ..... 123/41.31

* cited by examiner

*Primary Examiner*—Thomas N. Moulis
(74) *Attorney, Agent, or Firm*—John A. VanOphem

(57) ABSTRACT

A fuel injection system is provided for use in an internal combustion engine, where the engine includes at least one cylinder head cover. The fuel injection system includes at least one fuel injector assembly that is inserted into an inlet in the cylinder head cover. The fuel injector assembly includes an upper body portion and a lower body portion that extends through the inlet of the cylinder head cover, where at least part of the lower body portion is comprised of a low radiant heat absorbent material having a high radiant heat reflectance color for reflecting radiant heat away from the fuel injector assembly during engine operating conditions.

20 Claims, 1 Drawing Sheet

METHOD FOR DISSIPATING HEAT AT THE TIP OF A FUEL INJECTOR

TECHNICAL FIELD

The present invention relates generally to a fuel injection system for use in an internal combustion engine and, more particularly, to a method for dissipating heat at the tip of a fuel injector.

BACKGROUND OF THE INVENTION

Fuel injection systems for spraying fuel into internal combustion engines are well known in the automotive engine art. Fuel injectors generally provide extremely accurate control of the air-fuel mixture needed to start and operate the engine. However, under certain high engine temperature conditions, the fuel at the tip of the fuel injector may vaporize prior to being sprayed into the engine. As a result, the air-fuel mixture injected into the combustion chamber is adversely effected such that the fuel injector system may decrease engine efficiency and/or increase engine emission levels.

Therefore, it is desirable to provide a method for dissipating heat at the tip of the fuel injector, thereby facilitating engine start-up during certain engine operating conditions.

SUMMARY OF THE INVENTION

In accordance with the present invention a fuel injection system is provided for use in an internal combustion engine where the engine includes at least one cylinder head cover. The fuel injection system includes at least one fuel injector assembly that is inserted into an inlet in the cylinder head cover. The fuel injector assembly includes an upper body portion and a lower body portion that extends through the inlet of the cylinder head cover, where at least part of the lower body portion is comprised of a low radiant heat absorbent material having a high radiant heat reflectance color for reflecting radiant heat away from the fuel injector assembly during engine operating conditions.

For a more complete understanding of the invention, its objects and advantages, refer to the following specification and to the accompanying drawings.

DESCRIPTION OF THE PREFERRED EMBODIMENT

Figures 1, 2:
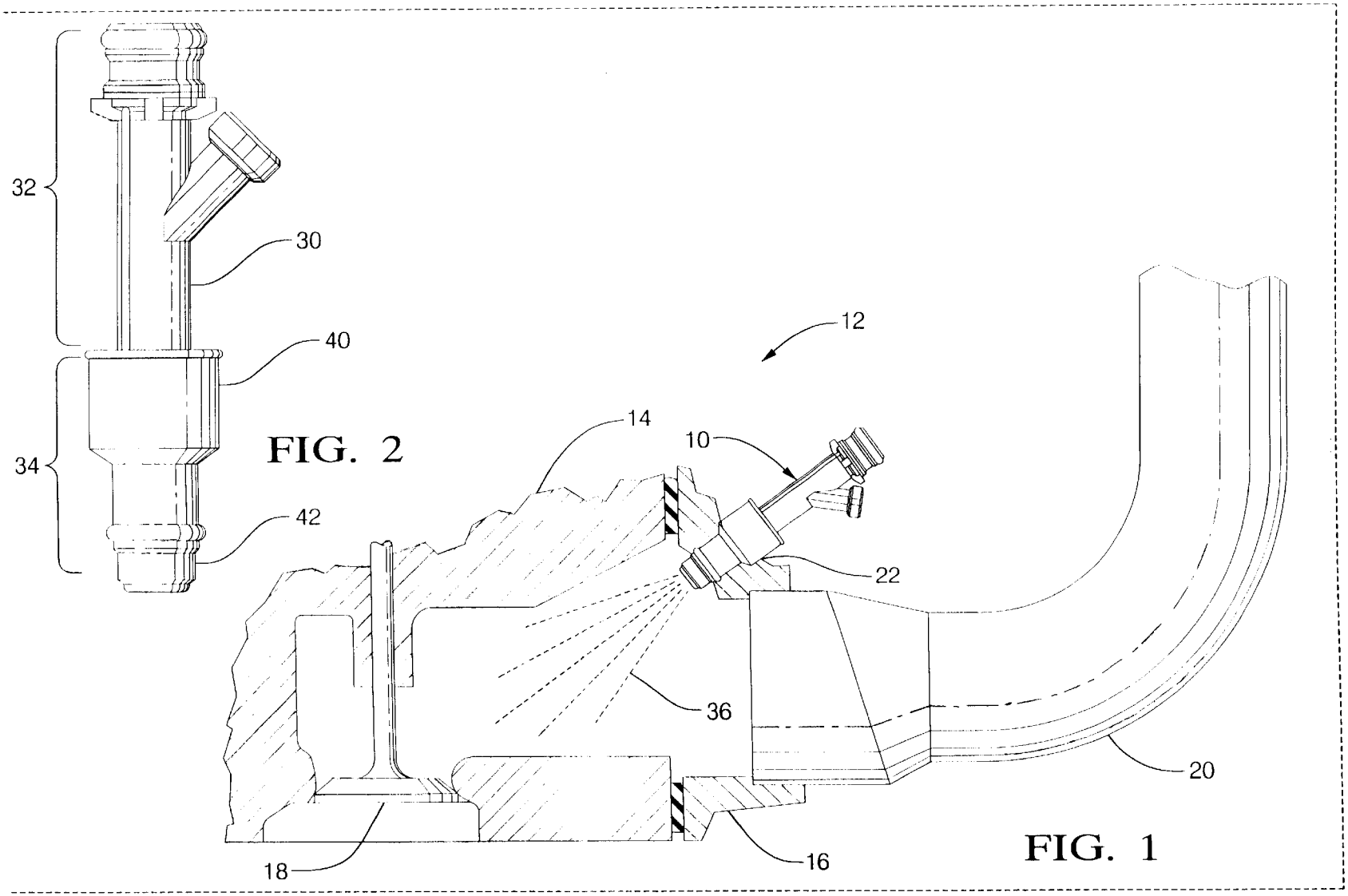
FIG. 1 is a diagram of an exemplary fuel injection assembly for use in a fuel injection system in accordance with the present invention.
FIG. 2 is a diagram of the fuel injector assembly in accordance with the present invention.

An exemplary fuel injector assembly 10 embodying features of the present invention is illustrated in FIGS. 1 and 2. In FIG. 1, the fuel injector assembly 10 is shown with other portions of a fuel injection system 12. The fragmentary, cross-sectional view of the fuel injection system 12 depicts a cylinder head cover 14, a cylinder head 16, an intake valve 18 and an intake manifold 20. While the following description is provided with reference to a particular configuration for the fuel injection system 12, it is readily understood that the broader aspects of the present invention are applicable to other types of and/or configurations for the fuel injector system 12.

The fuel injector assembly 10 is comprised of a cylindrical injector body 30 which encases the internal components (not shown) of the fuel injector. The injector body 30 is defined as having an upper body portion 32 and a lower body portion 34. The fuel injector assembly 10 is then inserted through an inlet 22 in the cylinder head cover 14, such that a portion of the lower body portion 34 extends into an internal chamber 36 within the cylinder head cover 14. The injector body 30 is typically comprised of a black colored material. Black colored materials tend to absorb radiant heat, whereas white colored materials tend to reflect radiant heat. In accordance with the present invention, at least part of the lower body portion 34 is comprised of a low radiant heat absorbent material having a high radiant heat reflectance color for reflecting radiant heat away from the lower body portion 34 of the fuel injector assembly 10.

Referring to FIG. 2, an upper retainer 40 and a lower o-ring retainer 42 may be assembled onto the outside of the injector body 30. The upper retainer 40 slides over the cylindrical structure of the injector body 30 to define an expanded diameter portion of the fuel injector assembly 10. Upon insertion into the inlet of cylinder head cover 14, the upper manifold retainer 40 engages against the outer surface of the cylinder head cover 14. The o-ring retainer 42 is fixed at an outlet end of the injector body 30 and is used to retain a conventional o-ring. Each of these retainers are typically made from a black colored material.

In the present invention, the two retainers 40 and 42 are made from white or natural colored nylon material. During engine operating conditions, radiant heat from the intake manifold, the cylinder head and other adjacent engine components are reflected away from the lower portion of the fuel injector assembly by the white colored material of the retainers, thereby reducing the temperature at the tip of the fuel injector. Depending the specific engine operating conditions, the temperature may be reduced from 3 to 6 degrees C. Although it is envisioned that other portions of the injector body and/or associated external components assembled thereto may be made from a low absorbent material having a high reflectance color, the above-description represents a preferred embodiment of the present invention.

In this preferred embodiment, the remainder of the injector body is made from black nylon or other suitable black colored material. In another aspect of the present invention, the upper body portion 32 of the injector body 30 emits (or gives up) radiant heat from the fuel injector, thereby further reducing the temperature associated with the fuel injector assembly 10.

While the above description constitutes the preferred embodiment of the invention, it will be appreciated that the invention is susceptible to modification, variation, and change without departing from the proper scope or fair meaning of the accompanying claims.

What is claimed is:

1. A fuel injection system for use in an internal combustion engine, the engine having at least one cylinder head cover, comprising: a fuel injector assembly inserted into an inlet in the cylinder head cover, the fuel injector assembly includes an upper body portion and a lower body portion that partially extends through the inlet of the cylinder head cover, wherein at least part of the lower body portion is comprised of a low absorbent material having a high reflectance color for reflecting heat away from the lower body portion of the fuel injector assembly.

2. The fuel injection system of claim 1 wherein the low absorbent material is nylon.

3. The fuel injection system of claim 1 wherein the high reflectance color is white.

4. The fuel injection system of claim 1 wherein the lower body portion further includes an upper retainer for engaging the cylinder head cover and a seal retainer fixed on an outlet end of the fuel injector assembly, where the upper retainer and the seal retainer are comprised from a low absorbent material having a high reflectance color.

5. The fuel injection system of claim 1 wherein the upper body portion is a high absorbent material having a low reflectance color for emitting radiant heat from the upper body portion of the fuel injector assembly.

6. A method for dissipating heat at the tip of a fuel injector in an internal combustion engine, the engine having at least one cylinder head cover, comprising the steps of:

providing a fuel injector assembly that includes an upper body portion and a lower body portion, wherein at least part of the lower body portion is comprised of a low absorbent material having a high reflectance color;

inserting the fuel injector assembly into an inlet in the cylinder head cover, such that the lower body portion of the fuel injector assembly extends through the inlet of the cylinder head cover; and reflecting heat away from the lower portion of the fuel injector assembly during engine operating conditions.

7. The method of claim 6 wherein the low absorbent material is nylon.

8. The method of claim 6 wherein the high reflectance color is white.

9. The method of claim 6 wherein the lower body portion further includes an upper retainer for engaging the cylinder head cover and a seal retainer fixed on an outlet end of the fuel injector assembly, where the upper retainer and the seal retainer are comprised from a low absorbent material having a high reflectance color.

10. The method of claim 6 further comprising the step of emitting radiant heat from the upper body portion of the fuel injector assembly, where the upper body portion is a high absorbent material having a low reflectance color.

11. A fuel injection system for use in an internal combustion engine, the engine having at least one cylinder head cover comprising:

a fuel injector assembly inserted into an inlet in the cylinder head cover, the fuel injector assembly including, an upper body portion, and a lower body portion that at least partially extends through the inlet of the cylinder head cover, wherein at least part of the lower body portion comprises a radiant heat reflecting material such that any resulting temperature increase in the part of the lower body portion comprising the radiant heat reflecting material when subjected to radiant heat generated from the engine when in operation, is less than any temperature increase of the remainder of the fuel injector not comprising the radiant heat reflecting material.

12. The fuel injection system of claim 11 wherein the radiant heat reflecting material comprises nylon.

13. The fuel injection system of claim 12 wherein the nylon is selected from the group consisting of a white colored nylon and a natural colored nylon.

14. The fuel injection system of claim 11 wherein the lower body portion further includes an upper retainer made from a radiant heat reflecting material for engaging the cylinder head cover, and a seal retainer made from a radiant heat reflecting material fixed on an outlet end of the fuel injector assembly.

15. The fuel injection system of claim 11 wherein the lower body portion comprises a fuel injector tip.

16. The fuel injection system of claim 14 wherein the radiant heat reflecting material comprises nylon.

17. A method for dissipating heat at the tip of a fuel injector in an internal combustion engine, the engine having at least one cylinder head cover, comprising the steps of:

providing a fuel injector assembly that includes an upper body portion and a lower body option, wherein at least part of the lower body portion is comprises a radiant heat reflecting material;

inserting the fuel injector assembly into an inlet in the cylinder head cover, such that the lower body portion of the fuel injector assembly extends through the inlet of the cylinder head cover; and reflecting radiant heat away from the lower portion of the fuel injector assembly during engine operating conditions.

18. The method of claim 17 wherein the radiant heat reflecting material comprises nylon.

19. The method of claim 18 wherein the nylon is selected from the group consisting of a white colored nylon and a natural colored nylon.

20. The method of claim 17 wherein the lower body portion further includes an upper retainer made from a radiant heat reflecting material for engaging the cylinder head cover and a seal retainer made from a radiant heat reflecting material fixed on an outlet end of the fuel injector assembly.

* * * * *